United States Patent [19]

Unger et al.

[11] Patent Number: 4,756,509

[45] Date of Patent: Jul. 12, 1988

[54] MOBILE LIFTING JACK

[75] Inventors: Richard L. Unger; Thomas G. Bobick, both of Pittsburgh, Pa.

[73] Assignee: United States of America as represented by the Secretary of the Interior, Washington, D.C.

[21] Appl. No.: 21,271

[22] Filed: Mar. 3, 1987

[51] Int. Cl.[4] ..... B66F 3/00

[52] U.S. Cl. ..... 254/8 B

[58] Field of Search ..... 254/DIG. 1, DIG. 4, 254/84, 85, 8 B; 248/348, 298; 104/1 R; 7/100; 238/13; 52/79; 269/17

[56] References Cited

U.S. PATENT DOCUMENTS

| | | | |
|---|---|---|---|
| 942,170 | 12/1909 | Dunlap | 254/85 |
| 1,635,617 | 7/1927 | Hall | 254/85 |
| 1,887,924 | 11/1932 | Evans | 254/1 |
| 2,580,743 | 1/1952 | Eckels | 254/1 |
| 3,588,046 | 6/1971 | Weaver | 254/85 |
| 4,089,426 | 5/1978 | Sheppard | 254/85 |
| 4,427,178 | 1/1984 | Kozlowski | 254/1 |
| 4,640,495 | 2/1987 | Parsons | 254/8 B |

*Primary Examiner*—Robert C. Watson

*Attorney, Agent, or Firm*—E. Philip Koltos

[57] ABSTRACT

A mobile jack, particularly for use in installation of support beams in underground mines, is disclosed. The jack comprises a wheel-mounted frame and a hydraulic lifting arm having a jack head which is horizontally rotatable 360°. The lifting arm is also longitudinally positionable along the length of the mobile jack. The lifting arm is manually raised and lowered by pumping a lever connected to a hydraulic jack cylinder.

6 Claims, 1 Drawing Sheet

MOBILE LIFTING JACK

FIELD OF THE INVENTION

The present invention relates to a mobile lifting jack for transporting and lifting heavy articles.

BACKGROUND OF THE INVENTION

Underground mines must be reinforced by installing large beams to support the ribs and roofs of mine entries and haulageways. These beams are often cumbersome, difficult to handle, and may weigh as much as 300 pounds. Presently, these beams are installed by hand. This process entails lifting a beam weighing up to 500 pounds up to the roof of an entry or haulageway to a horizontal position and then emplacing two or more vertical beams to support the horizontal ceiling beam. Lifting such as this requires intense physical exertion and is quite dangerous to the miners.

Observations of miners installing these underground roof supports led to the idea of developing a simple, reliable, safe, and inexpensive device to reduce the physical labor involved in this process. The device was designed to transport the beam to the desired installation point and then to lift the beam up to a position on the roof such that the necessary support beams can be emplaced underneath. A short report and photograph of such a device is contained in *Proceedings - 4th Annual Meeting C.A.M.E.,* Oct. 1985, p. 120.

General prior art lifting devices include these described in U.S. Pat. Nos. 3,758,076 (Tranchero) and 4,513,950 (Yamagishi). The Tranchero patent describes a mobile, high power hydraulic jack designed to lift motor vehicles. This jack includes a lifting arm mounted on a base frame and is capable of lifting vehicles and transporting them from place to place. The Yamagishi patent also discloses a mobile, hydraulic lifting jack designed to lift vehicles. This jack is pivotally mounted on its frame such that it may rotate 360°.

SUMMARY OF THE INVENTION

The present invention relates to a mobile jack designed to lift heavy objects. The device comprises a generally rectangular frame with wheel means attached to the frame for imparting mobility to the frame. A hydraulic cylinder is mounted to the frame. Lever means are provided for controlling the hydraulic cylinder. A lifting arm is attached to a first end to the hydraulic cylinder such that the lifting arm may be moved between a raised position and a lowered position by the hydraulic cylinder. A jack head is rotatably attached to the other, second end of the lifting arm. A means for positioning the hydraulic cylinder at any point along the length of the frame is also provided.

In addition, the present invention may include at least two bearing mounted rollers journalled in a pair of channel tracks for positioning the hydraulic cylinder at any point along the length of the frame. The frame itself may include a flat bed for transporting objects to the desired installation location. The jack head is attached to the lifting arm in such a manner as to maintain the jack head level as the lifting arm is moved from its lowered position to its raised position. The present invention may be adapted to travel either on railroad tracks or on a wide variety of terrains through the use of the appropriate wheel means.

It is an object of the present invention to provide a combined carrying and lifting means capable of transporting heavy beams to the installation site and then lifting the beams into the installation position.

It is also an object of the present invention to provide a device for use in mines to reduce the amount of physical labor required to reinforce mine entries and haulageways during their excavation.

It is a further object of the present invention to reduce the number of injuries related to the handling of materials by miners.

It is still a further object of the present invention to provide a means for lifting heavy objects which objects are then capable of being rotated 360° as well as being movable longitudinally independent of the frame.

Other features and objects of the present invention are stated in or apparent from a detailed description of the invention found hereinbelow.

DETAILED DESCRIPTION OF THE PREFERRED EMBODIMENT

Figure 1:
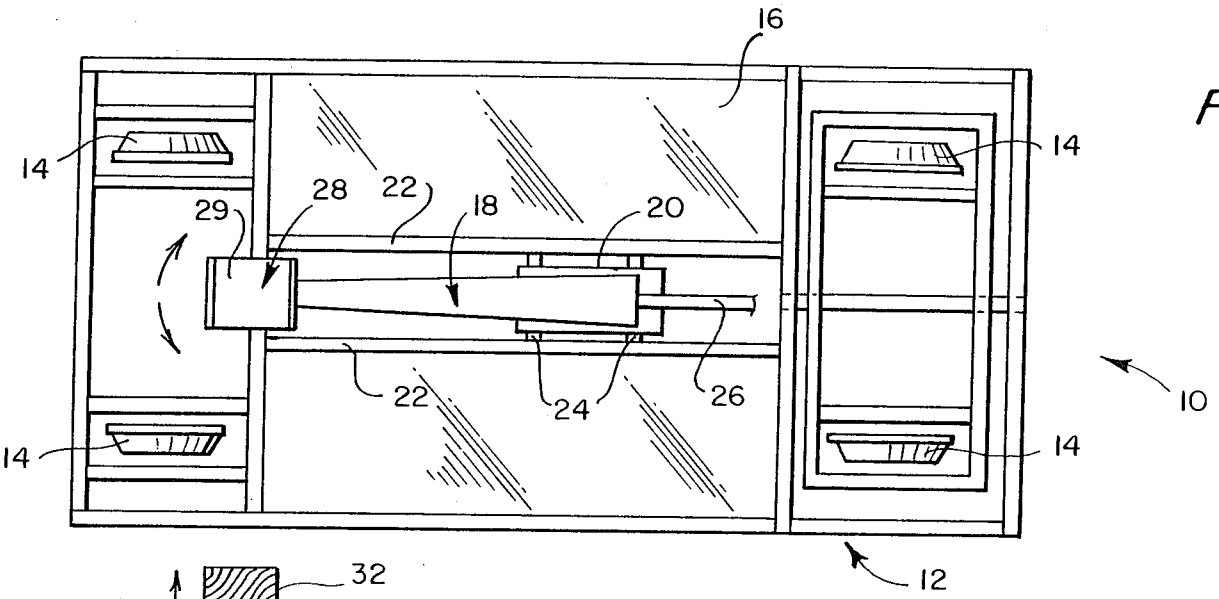
FIG. 1 is a top view of a mobile jack of the present invention in a raised position.
Figure 2:
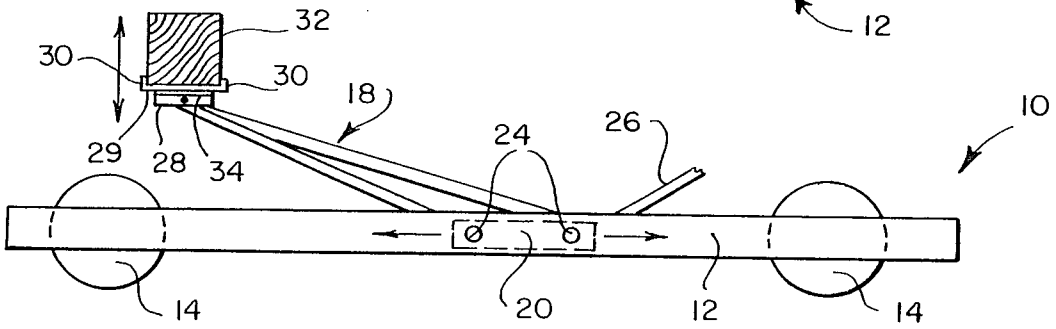
FIG. 2 is a side view of the mobile jack depicted in FIG. 1 in a raised position.

With reference now to the drawings in which like numerals represent like elements throughout the several views, a mobile jack 10 according to the present invention is depicted in FIGS. 1 and 2. Mobile jack 10 includes a frame 12 which is preferably of a generally rectangular shape and disposed horizontally. Frame 12 is composed of six inch channel sections which impart strength to frame 12. The channel sections also ensure that frame 12 is light so that mobile jack 10 is easy to move. Frame 12 has four wheels 14 attached thereto. These wheels 14 are adapted for travel along railroad tracks. However, wheels 14 may be rubber tires adapted for travel over a wide variety of terrain if desired. Mobile jack 10 includes a flat bed 16 for use in transporting heavy objects to the job site. Flat bed 16 may be constructed simply by attaching steel plate over frame 12.

A lifting arm means 18 is attached to a hydraulic jack 20 which is mounted in the center of frame 12 on a pair of channel tracks 22. Hydraulic jack 20 is mounted on channel tracks 22 by a pair of bearing mounted rollers 24 such that hydraulic jack 20 is movable longitudinally along channel tracks 22 as indicated by the horizontal arrows in FIG. 2. This provides for the precise positioning of lifting arm means 18 without requiring movement of the entire mobile jack 10. Hydraulic jack 20 is actuated by a lever 26 which must be manually pumped to raise lifting arm means 18. Lifting arm means 18 is raised from its lowered generally horizontal position to its raised, generally vertical position by pumping lever 26.

Attached to lifting arm 18 is a jack head 28 which consists of a flat surface 29 bounded on two opposite sides by raised flanges 30. Flat surface 29 is pivotally attached to lifting arm means 18 on a suitable turntable 34 for rotation about a vertical axis. This provides great flexibility when positioning the object being lifted. In this particular embodiment of mobile jack 10, jack head 28 is designed for lifting beams 32. As shown, a long rectangular beam 32 is placed on jack head 28 in a manner wherein the flanges 30 serve to maintain beam 32 on the jack head 28. Jack head 28 is mounted on lifting arm means 18 in a known way such that jack head 28 remains level while lifting arm means 18 is raised and lowered. When lifting arm means 18 is in its lowered, generally horizontal position, jack head 28, hydraulic jack 20 and lifting arm means 18 are all below the level of flat bed 16. This aids the user in loading beam 32 onto jack head 28 from flat bed 16. Mobile jack 10 is designed particularly for use in the installation of roof support beams in underground mines.

In operation, beams 32 are loaded onto flat bed 16 at a convenient location. Mobile jack 10 is then moved to the desired installation point. Then, a beam 32 is manually or otherwise placed on jack head 28 and lever 26 is manually pumped to raise beam 32. Beam 32 is positioned by rotating jack head 28 and by moving hydraulic jack 20 longitudinally along channel tracks 22. Once beam 32 is in position, hydraulic jack 20 holds beam 32 in place while workers install vertical support members under beam 32. Hydraulic jack 20 is then lowered or retracted by releasing the hydraulic pressure (typically by twisting lever 26). Mobile jack 10 is then moved to the next installation point and the process is repeated.

Although the present invention has been described in detail with respect to an exemplary embodiment thereof, it will be understood by those of ordinary skill in the art that variations and modifications can be effected within the scope and spirit of the invention.

We claim:

1. A mobile jack for lifting heavy objects comprising:

a generally rectangular, horizontally disposed, elongate frame;

wheel means attached to said frame for movably mounting said frame relative to a supporting surface;

a hydraulic cylinder whose length is adjustable;

control means for controlling the adjustable length of said hydraulic cylinder;

a cylinder mounting means for mounting said hydraulic cylinder for longitudinal movement on said frame such that the object to be lifted may be positioned relative to said frame;

a jack head on which the object to be lifted is mounted;

an elongate lifting arm means for lifting said jack head having a first end and a second end, said first end being attached to said hydraulic cylinder such that adjustment of the length of said hydraulic cylinder causes said second end to be moved vertically; and a head mounting means for mounting said jack head rotatably to said second end of said lifting arm means whereby said jack head is rotatable about a vertical axis.

2. A mobile jack as claimed in claim 1 wherein said cylinder mounting means comprises:

a pair of channel tracks mounted in said frame which extend along the longitudinal length of said frame; and at least two bearing mounted rollers attached to said hydraulic cylinder and journalled in said channel tracks such that said bearing mounted rollers travel along said channel tracks.

3. A mobile jack as claimed in claim 2 wherein said lifting arm means is moved from a lowered generally longitudinal loading position to a raised, generally vertical lifting position.

4. A mobile jack as claimed in claim 3 wherein said generally rectangular frame further comprises a flat bed for carrying the objects to be lifted by said jack.

5. A mobile jack as claimed in claim 4 wherein said frame includes a recess in which said jack head, said lifting arm means, and said hydraulic cylinder are located when said lifting arm means is in the lowered position, said recess being located below the level of said flat bed.

6. A mobile jack as claimed in claim 5 wherein said wheel means are adapted to engage railroad tracks.

* * * * *